United States Patent [19]

Honovich

[11] Patent Number: 4,892,140

[45] Date of Patent: Jan. 9, 1990

[54] CONDENSER VENT SIPHON LINE

[76] Inventor: Tito D. Honovich, 149-24 21st Ave., Whitestone, N.Y. 11357

[21] Appl. No.: 273,844

[22] Filed: Nov. 21, 1988

[51] Int. Cl.[4] ..... F28B 1/02; F28B 9/10

[52] U.S. Cl. ..... 165/110; 165/917

[58] Field of Search ..... 165/110, 111, 104.32, 165/917

[56] References Cited

U.S. PATENT DOCUMENTS

| | | | |
|---|---|---|---|
| 1,721,287 | 7/1927 | Taddiken | 165/112 |
| 1,728,284 | 12/1926 | Gray | 165/112 |
| 1,849,196 | 3/1932 | Meurk et al. | 165/110 |
| 2,111,867 | 1/1937 | Miller et al. | 165/112 |
| 2,924,438 | 2/1960 | Malkoff | 165/110 |
| 4,781,247 | 11/1988 | Schulz | 165/110 |

*Primary Examiner*—Albert W. Davis, Jr.

*Attorney, Agent, or Firm*—Brooks Haidt Haffner & Delahunty

[57] ABSTRACT

Air trapped in the water boxes of a heat exchanger such as the surface condenser employed in conjunction with a power plant steam turbine is automatically and continuously removed to a water discharge pipe of the heat exchanger system by means of a vacuum generated by the flow of water being discharged from the system. Energy sources external to the system are eliminated.

21 Claims, 7 Drawing Sheets

10
11
12
13
14
15
16
17
18
19
20

10
11
12
14
15
16
17
18
40
41
45
46
47

E
55
39
W
38
12
20a
20b
16
13
10
14
18
11
15
17

CONDENSER VENT SIPHON LINE

BACKGROUND OF THE INVENTION

The invention relates to improving the performance of surface condensers such as those used in power plants in conjunction with steam turbines. By using the dynamics of water flow circulated through the condenser, the device of the invention exhausts air and non-condensible gases from the water boxes of the condenser.

DESCRIPTION OF THE PRIOR ART

It is known to interconnect the inlet and outlet water boxes of a surface condenser to equalize the pressure of air which accumulates at the tops of such boxes during condenser operation. Steam siphons have been used to remove air from the tops of the boxes periodically to maintain a proper water level in the water boxes, but use of these siphons is power-consuming.

U.S. Pat. No. 2,111,867 to Miller relates to an arrangement for automatically removing air from surface condenser water boxes by suction of air from the water box to the vacuum side of the condenser itself. Miller's arrangement employs a trap and a standpipe containing a column of water.

SUMMARY OF THE INVENTION

Surface condensers, such as those attached to the low pressure exhausts of steam turbines in power plants for production of a back pressure at the turbine exhaust, for condensing turbine exhaust steam for reuse and for deaeration of condensate, typically include a housing through which exhaust steam is circulated past an array of tubes through which cooling water is circulated from an inlet water box to an outlet water box. For such a condenser to operate most efficiently the surface level of water in the inlet and outlet water boxes must be kept at or above a certain height. However, air and non-condensible gases tend to accumulate above the water in the water boxes, pressing down the water level and deleteriously affecting the operation of the condenser by reducing the flow of cooling water. This trapped air and non-condensibles must be removed. In the past this removal has been accomplished by the periodic operation of devices such as steam siphons.

In accordance with the invention the trapped air and non-condensibles (hereafter simply referred to as air) is automatically and continuously removed by a siphon arrangement which is powered by the flow of coolant water itself and therefore requires no energy source except water flow.

Several embodiments of the arrangement of the invention are illustrated and described. They all involve the use of conduits for withdrawing air from the tops of the water boxes to a point in the condenser discharge pipe downstream of the outlet water box, and all involve using the energy of the water flowing through the condenser discharge pipe to create a partial vacuum to withdraw the air from the water boxes.

In the simplest embodiments of the invention conduits connect the upper parts of the water boxes to a suction cup or venturi tube situated in the condenser discharge pipe so that suction produced by the flow of water past the suction cup or venturi pulls the trapped air from the water boxes into the stream of discharge water to exit the system therewith. Other embodiments employ a vacuum pump driven by a propeller positioned in the discharge pipe to withdraw the trapped air from the water boxes down to the discharge pipe.

One particularly preferred embodiment employs the use of waste water from other plant operations as a priming flow introduced into the condenser discharge conduit to assure steady state operation of the system.

The invention thus provides a passive system with few or no moving parts which continuously and automatically removes trapped air from condenser water boxes for optimal condenser operation. The invention will be more fully understood when the following detailed description is read in conjunction with the accompanying drawings.

BRIEF DESCRIPTION OF THE DRAWINGS

In the several figures of the drawings, in which like reference characters denote like parts throughout.

DETAILED DESCRIPTION OF PREFERRED EMBODIMENTS

Figure 1:
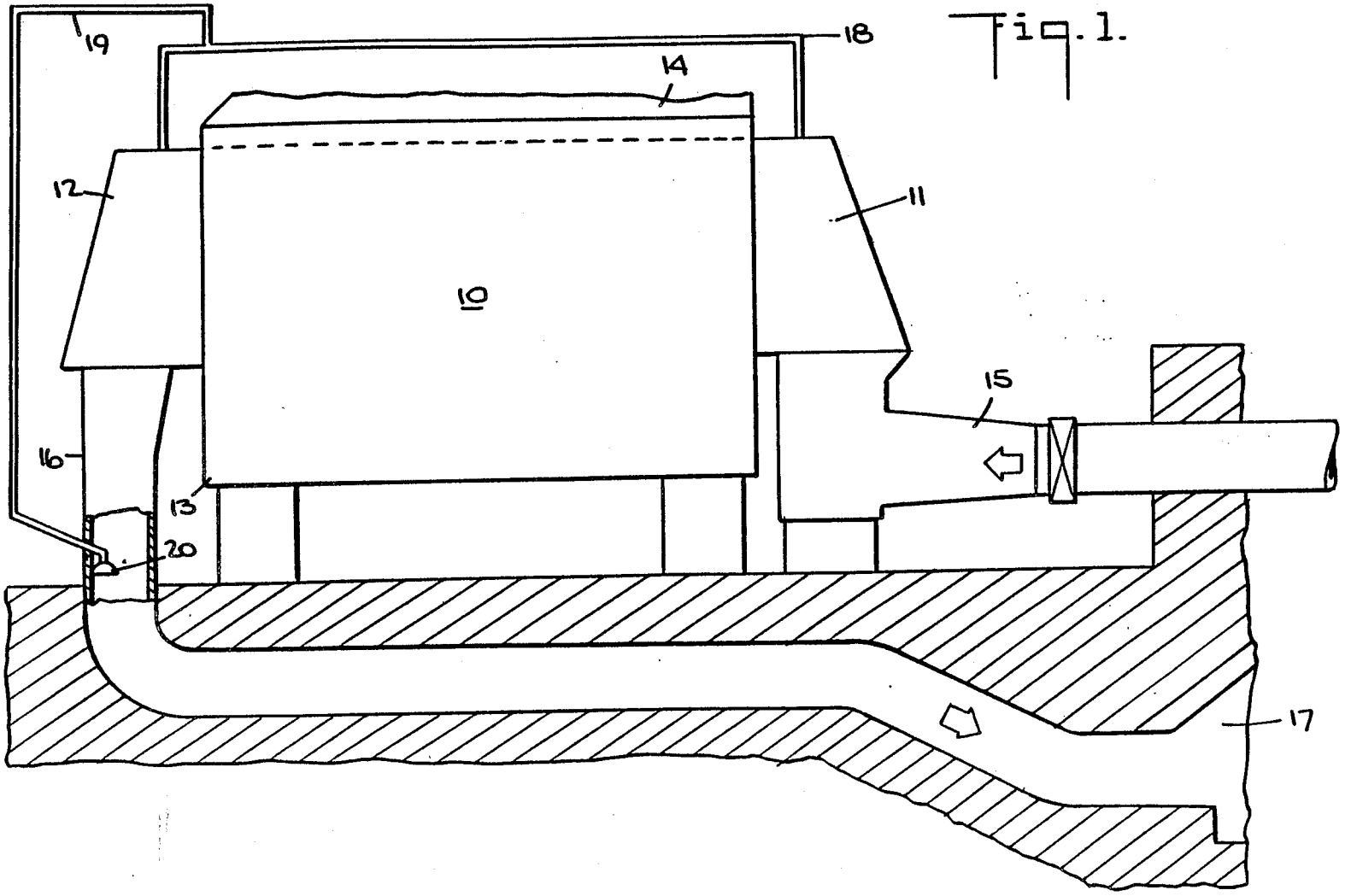
FIG. 1 is a somewhat schematic view of the condenser vent siphon line arrangement of the invention.

A heat exchanger generally designated by the reference numeral 10 in FIG. 1, which does not have its heating surface illustrated in detail, is exemplary of any and all heat exchangers which have an inlet water box 11 and an outlet water box 12 for the exchange of heat between a medium in vapor form, such as steam, and a liquid coolant medium such as water. For example, the heat exchanger 10 can be a surface condenser of the type in which steam from the exhaust side of a turbine (not shown) in a power plant is cooled by contact with water circulated through tubes within a housing 13. Such a surface condenser would have an entry for steam, not shown, at the upper portion 14 of the housing 13, where FIG. 1 shows parts broken away to simplify illustration of other parts. A surface condenser would also have outlets for steam which has not been condensed and for condensate, for example at the bottom of the housing 13, but such outlets are not illustrated because the invention is applicable to a wide variety of heat exchangers of the type having inlet and outlet water boxes shown at 11 and 12.

Coolant water enters the inlet water box 11 via an inlet pipe 15 from a supply of water such as a river, lake or sea and flows in the direction of the arrows to the inlet water box 11, through pipes or the like inside the heat exchanger housing 13 in contact with vapor to be condensed, passes on to the outlet water box 12 and thence through a discharge pipe 16 to an outlet 17.

Efficient operation of heat exchangers of the type illustrated in FIG. 1 and in the other figures yet to be described requires that the inlet and outlet water boxes 11 aND 12 be filled or at least that the surface level of the water in boxes 11 and 12 be maintained above a certain height to maintain optimum flow of coolant through the heat exchange element within the heat exchanger housing 13. However, during operation of such heat exchangers air and non-condensible gases which enter with the coolant water exit from the water to be trapped at the upper portions of water boxes 11 and 12. These air pockets tend to depress the level of the water in the boxes, and will materially affect operation of the heat exchanger if the trapped air is not withdrawn or otherwise released. Conventionally such withdrawal of trapped air from the air pockets in water boxes such as the boxes 11 and 12 is achieved by periodic operation of air removal means such as steam siphons, which require external power.

In the apparatus illustrated in FIG. 1, the upper portions of the inlet and outlet water boxes 11 and 12 are interconnected by a pressure equalization pipe 18. The pipe 18 removes air from the inlet water box 11 where the pressure is higher, to the outlet water box 12, thus raising the water level in the inlet water box 11, but this withdrawn air is still trapped in the system at the upper portion of the outlet water box 12. As this trapped air accumulates, the water level in the outlet water box is lowered and the flow of coolant through the heat exchanger decreases.

In accordance with the present invention, the trapped air is withdrawn from the system to the discharge line 16. In the embodiment of FIG. 1, such withdrawal is accomplished through a conduit 19 which opens on to the pipe 18 and leads downward to terminate in a suction device, illustrated in FIG. 1 as a suction cup 20 positioned within the water discharge pipe 16. The cup 20 is simply a flaring lower end of the conduit 19 providing an opening facing in the direction of water flow through the discharge pipe 16, which opening is larger in area than the cross-sectional area of the conduit 19 and which accordingly causes an area of lowered pressure beneath the cup 20, thus causing air to be pulled down the conduit 19 by the partial vacuum created beneath the cup 20 by the flow of water past the cup 20. This withdrawn air is entrained by the water being discharged and exits the system at 17 along with the water.

Figure 2:
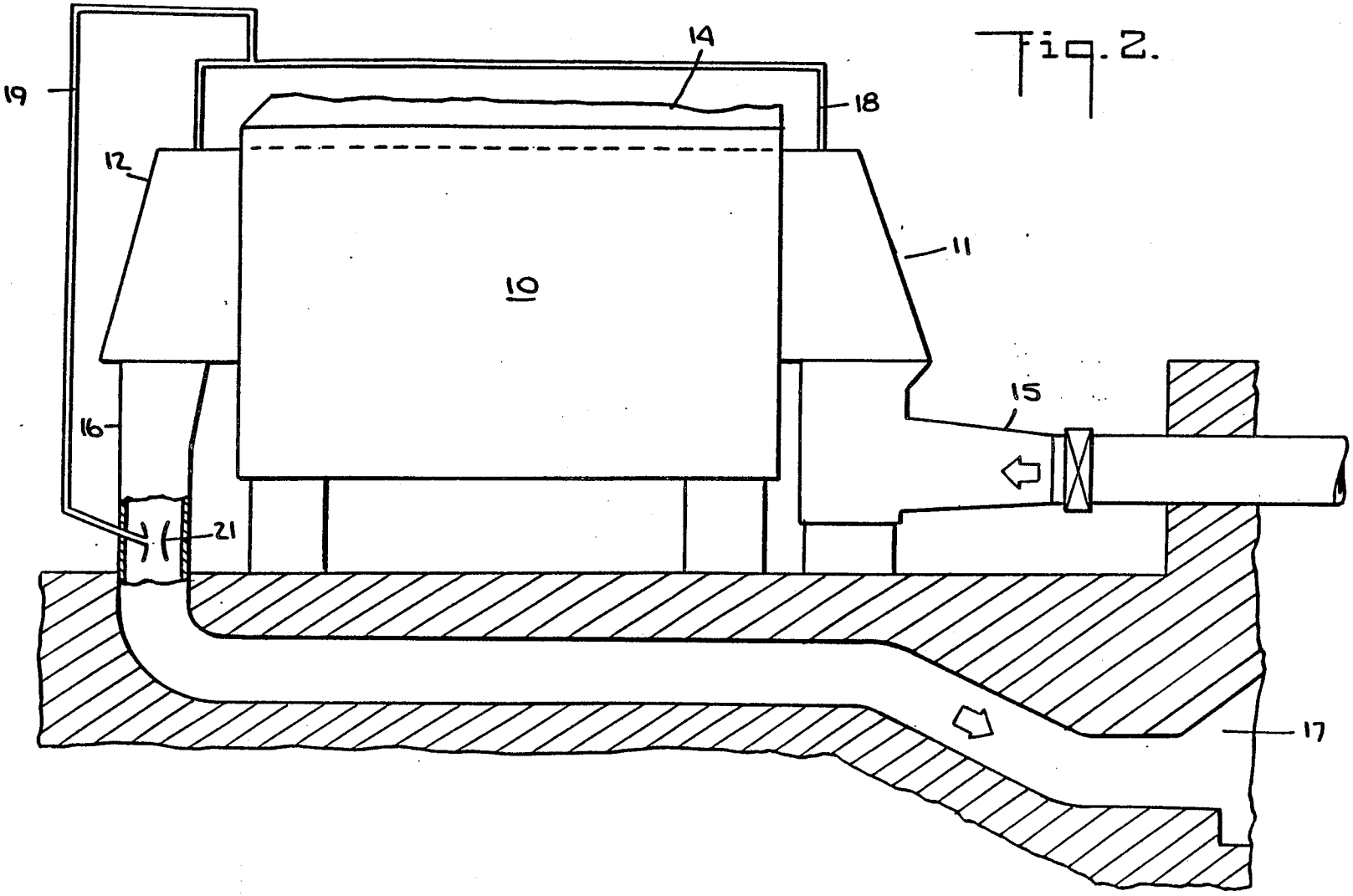
FIG. 2 is a view similar to FIG. 1 of another embodiment of the invention.

FIG. 2 shows an arrangement similar to that of FIG. 1 except that a suction cup 20 is replaced by a venturi tube 21 having a narrowed middle portion and gradually widening upper and lower tube portions. The flow of water through the restricted mid-portion of the venturi tube 21 creates an increased velocity at said mid-portion with a corresponding decreased pressure which serves to such air downward through pipe 19 and into the discharge pipe, just as in the embodiment of FIG. 1.

Figure 3:
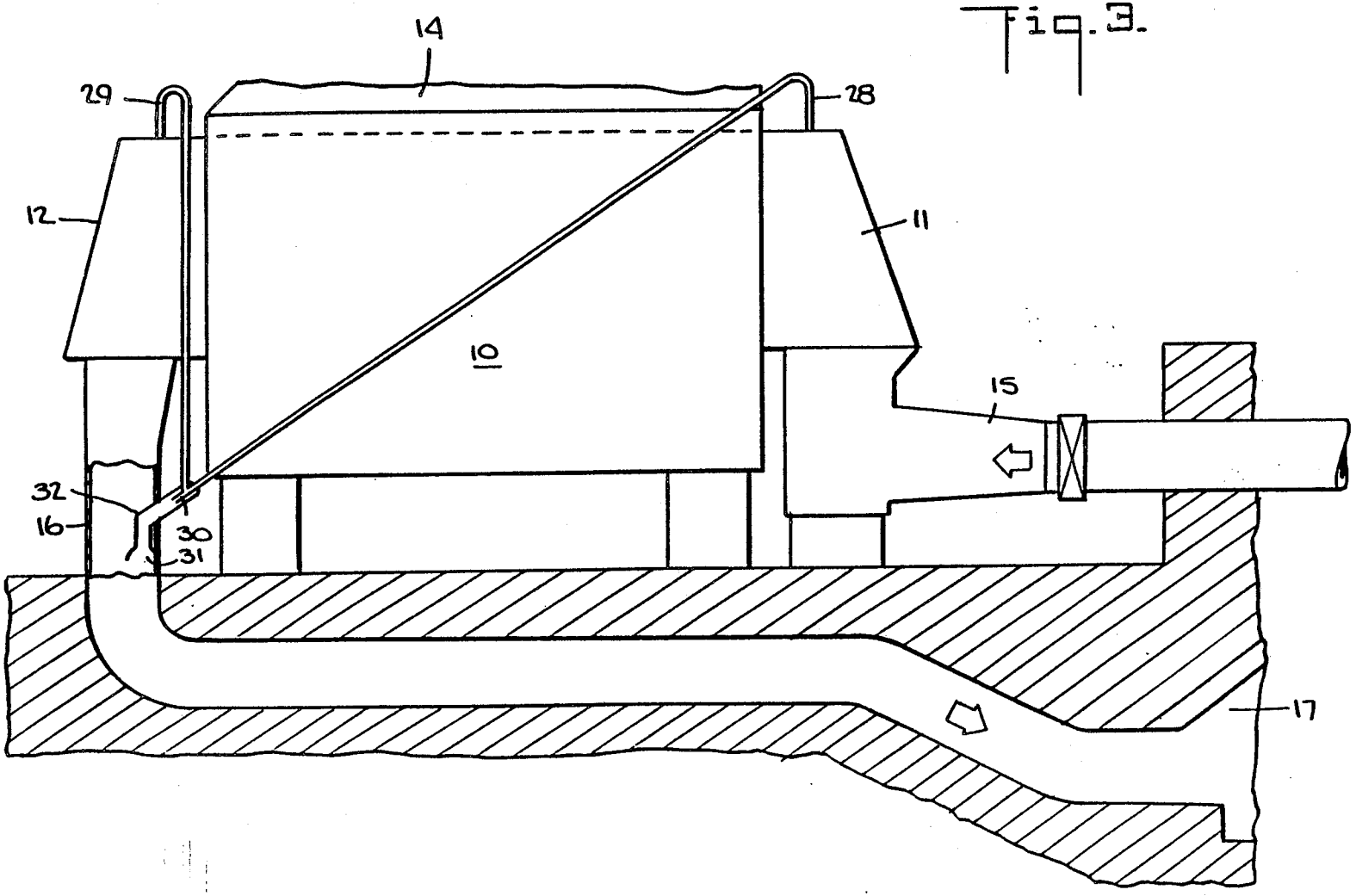
FIG. 3 is a view similar to that of FIGS. 1 and 2 of an embodiment of the invention in which the water boxes are not directly interconnected.

The pressure equalizing pipe 18 is eliminated in the embodiment shown in FIG. 3 of the drawing in which the vacuum or siphon effect created by a suction cup located, like the suction cup 20 of FIG. 1 in the water discharge pipe 16, is utilized to pull trapped air from both water boxes 11 and 12. A conduit 29 opening on to the upper portion of outlet water box 12 and a conduit 28 opening on to the upper portion of the inlet water box 11 are provided. The conduit 28 is advantageously provided with a restriction at 30 where conduit 28 is joined by conduit 29, followed by a segment of larger cross-sectional area as shown at 32 for utilizing the venturi effect to draw air from the outlet water box 12 into the air flow through conduit 28 from the inlet water box 11 and thence leading the combined air streams to the lowered pressure area formed by the flow of water past the suction cup 31 which operates in the same way as the suction cup 20 of FIG. 1.

Figure 4:
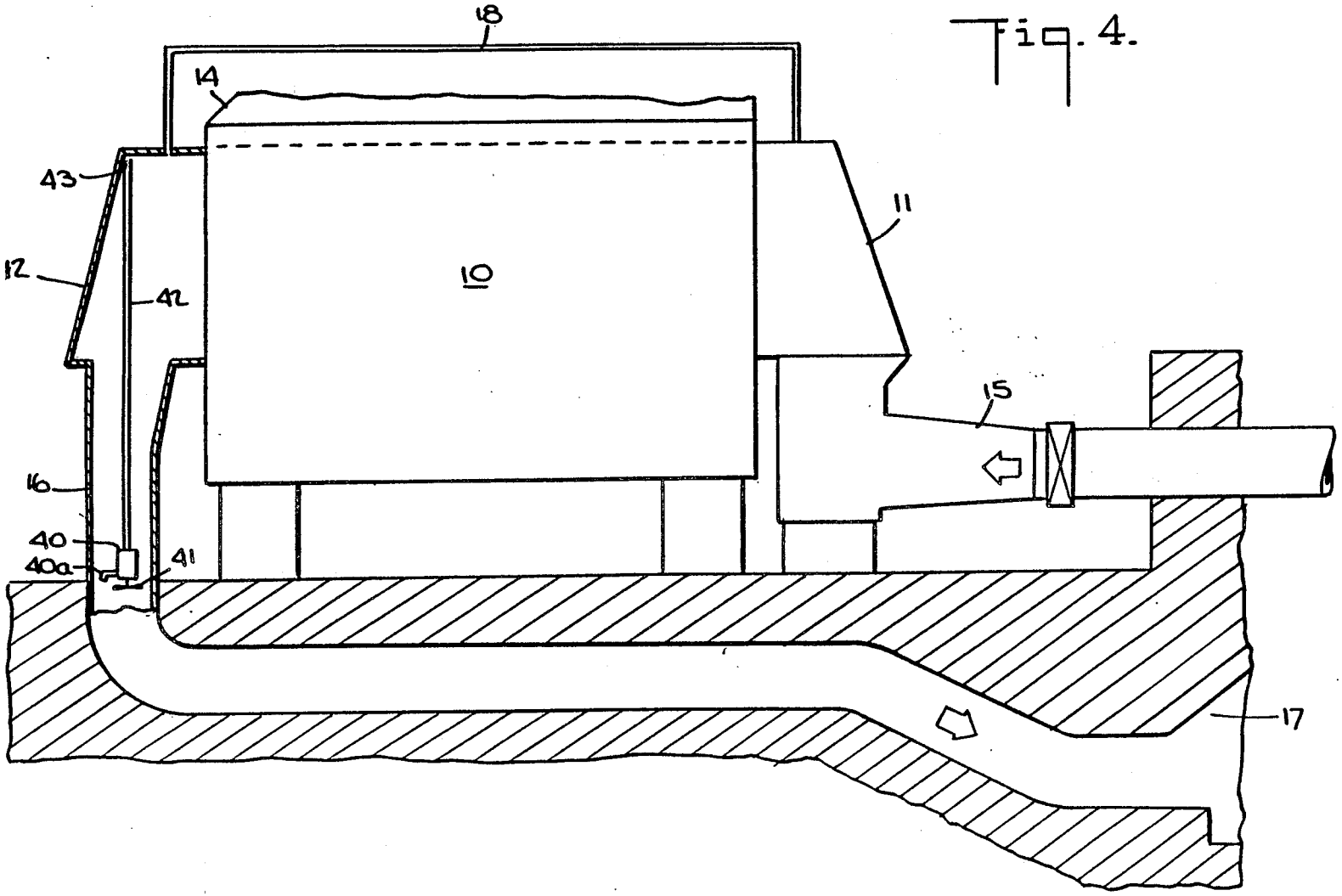
FIGS. 4 and 5 are views similar to those of FIGS. 1–3 showing two embodiments of the invention which use a vacuum pump for withdrawing trapped air from the water boxes.
Figure 5:
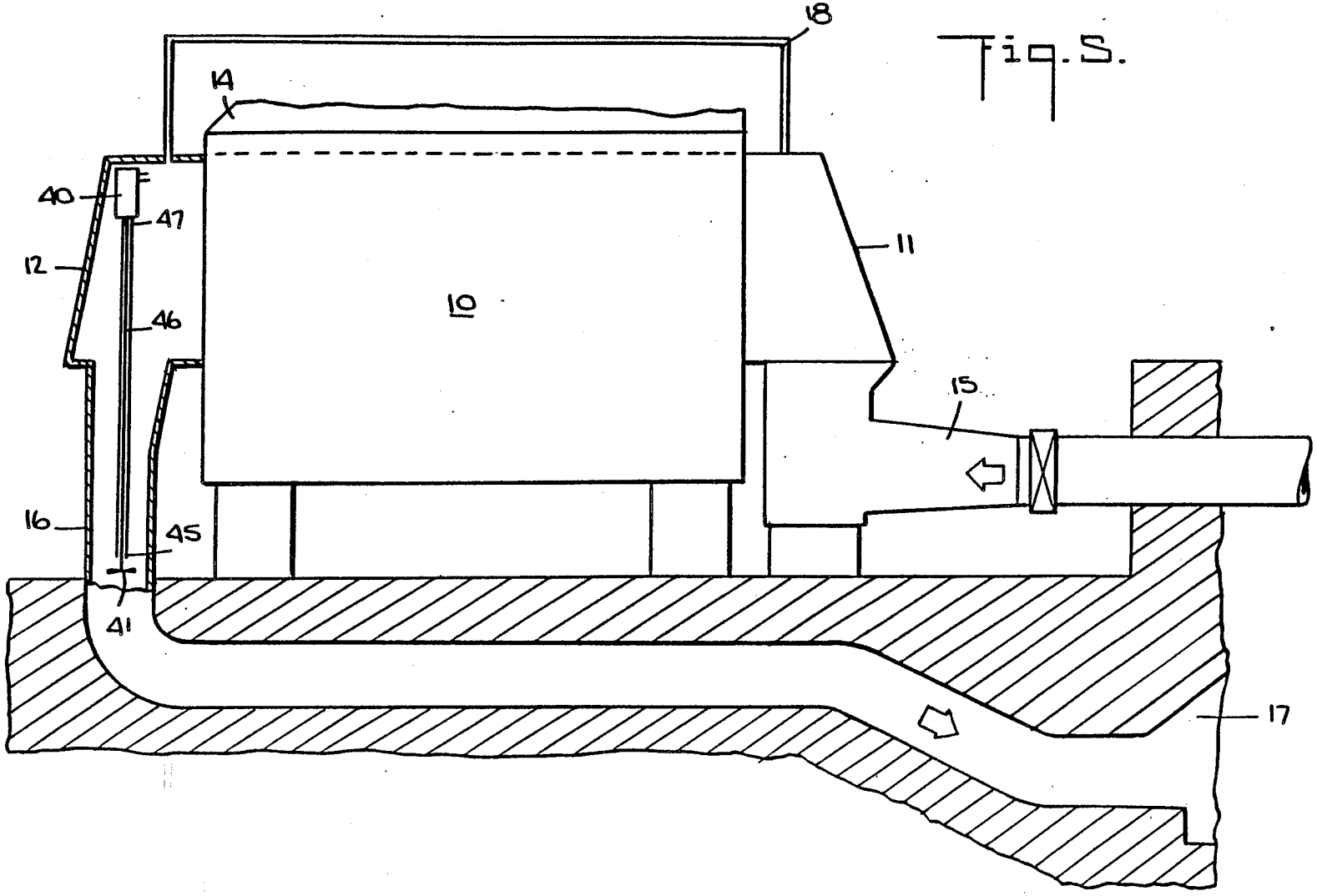

FIGS. 4 and 5 show embodiments of the invention in which a vacuum pump 40 is used to withdraw trapped air from the outlet water box into the water discharge pipe 16 to be entrained by and exit with the water discharged from the system at 17. In the embodiments of both FIGS. 4 and 5 the inlet and outlet water boxes 11 and 12 are interconnected by a pressure equalizing pipe 18.

FIG. 4 shows the vacuum pump 40 driven by the flow of water past a propeller 41 located adjacent the pump 40 within the water discharge pipe 16. The pump 40 of FIG. 4 is at the lower end of a conduit 42 the upper end 43 of which conduit opens on to the interior of the outlet water box 12 near the top of the box 12 for withdrawing trapped air therefrom down the conduit 42 by suction produced by the pump 40 to exit the pump through an air discharge nozzle 40*a*, whence the exiting air is entrained in the flow of water being discharged from the system.

In the embodiment of FIG. 5, the vacuum pump 40 is located within and near the top of the outlet water box 12 for withdrawing trapped air therefrom and pushing such withdrawn air down a conduit 47 which has its lower end opening within the water discharge pipe 16 at 45. A propeller 41 of the vacuum pump 40 is driven by the flow of water through the water discharge pipe 16 in the same manner as the propeller illustrated in FIG. 4. The propeller 41 of FIG. 5 is shown to be interconnected with the vacuum pump 40 via a drive shaft 46 extending longitudinally within the discharge conduit 47 which carries air impelled by the pump 40 down to the lower pipe opening at 45 where the air is entrained in the flow of water through the pipe 16 for discharge therewith at 17.

Plants of the type employing steam turbines often have waste water from other plant operations, which must be discharged. Such waste water can be, for example, water which has been used as a coolant medium. The embodiment of the invention illustrated in FIG. 6 employs such waste water to prime the system.

Waste water W at a pressure of 20 or more pounds per square inch (gauge) can be fed via priming conduit 55 to a venturi 38 positioned in the conduit 39 which leads from the top of the outlet water box 12 to the water discharge pipe 16. The introduction of this water under pressure through the venturi 38 produces a sufficient priming effect to prevent any reverse (upward) flow in the conduit 39. The water W may be fed by gravity in the form of waste water released from a heat exchanger or other equipment E located at a high elevation relative to the elevation of the venturi 38.

The venturi 38 and the others mentioned elsewhere in this application, can be of a suitably dimensioned commercially available type, for example, the "Jet Pump" sold by Penberthy-Houdaille, Inc.

Figure 6:
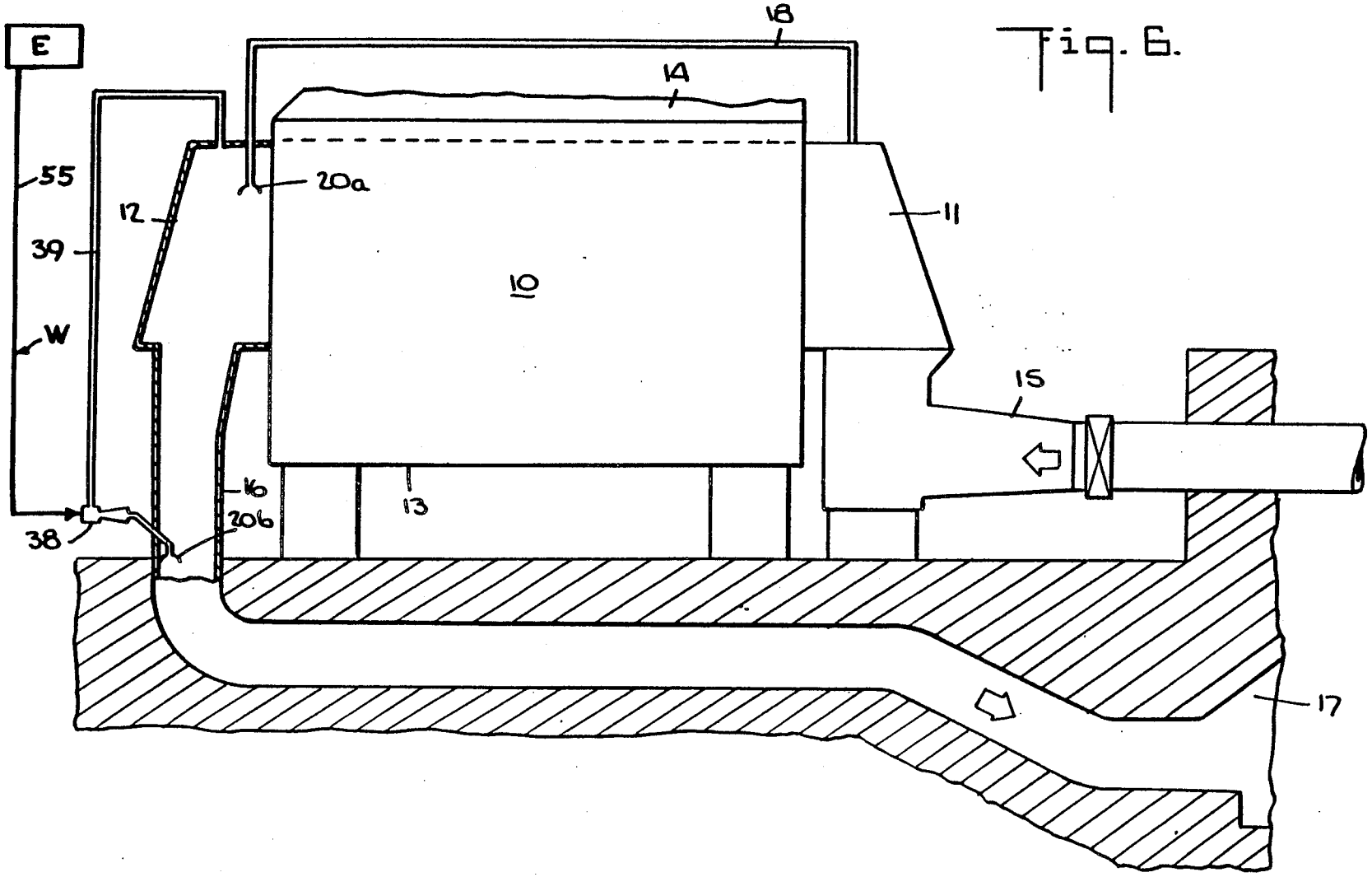
FIG. 6 is a somewhat schematic view of an embodiment of the invention which uses waste water to prime the system.

The conduit 39 terminates below the venturi 38, about 40 feet below its upper end, in a suction cup 20*b* or in a venturi (not shown) within the discharge pipe 16. Unlike the arrangement shown in FIGS. 1 and 2 the conduit 39 of FIG. 6 is not connected directly to the pressure equalization pipe 18. The pipe 18 enters the outlet water box 12 and terminates in a suction cup 20*a* submerged in the water collected in the water box 12, while the conduit 39 opens at its upper end in the space above the usual water level in the box 12.

Thus, in the arrangement of FIG. 6, the suction of cup 20*a* draws air from inlet water box 11 to the outlet water box 12; the suction of cup 20*b*, aided by the priming effect of water W introduced through the venturi 38 draws air from the top of the outlet water box 12; and the air exits, entrained in the water discharged to the recipient through outlet 17.

It has been found that, for best performance, the conduit 39 has a height of about 40 feet or more, and that the priming water fed to the conduit 39 via the venturi 38, has a pressure of twenty pounds per square inch gauge or more, preferably 20–40 p.s.i.g.

Figure 7:
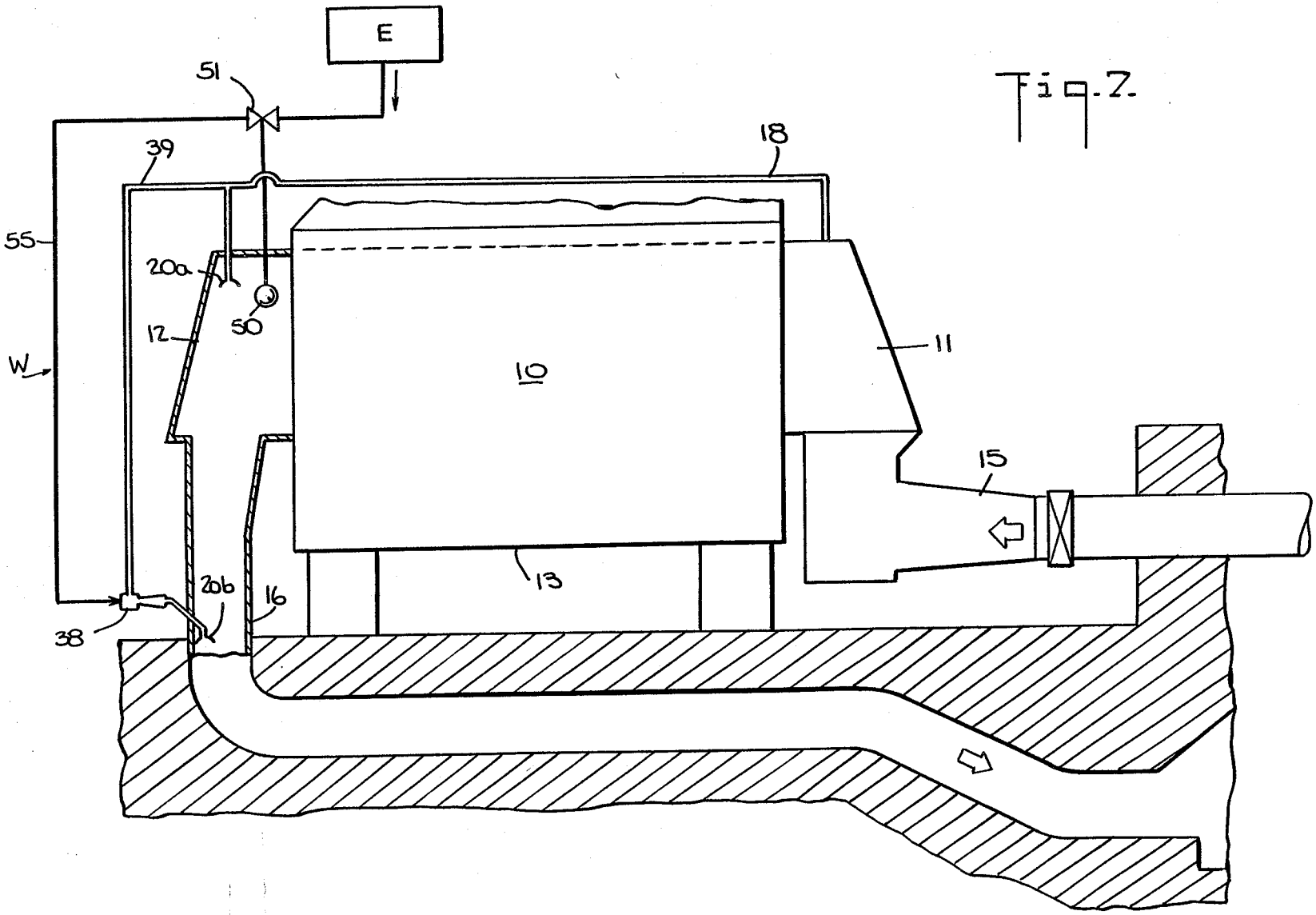
FIG. 7 shows an arrangement similar to that of FIG. 6, but also including a float for sensing water level in the outlet water box.

The embodiment of FIG. 7 is similar to that of FIG. 6 except that the pressure equalizing pipe 18 is connected to the conduit 39 as well as to the suction cup 20*a*. Further, a float 50 is placed in the outlet water box 12 to sense the water level therein. The float 50 is mechanically or otherwise connected to a shutoff valve 51 in the priming line 55 for feeding water W from equipment E to the venturi 38. Thus, priming water W will not flow unless the water level in outlet water box 12 drops below a predetermined level, whereupon the lowering of float 50 opens the valve 51 to cause the flow of water W to activate the venturi 38. The resulting additional siphon effect draws air at a greater rate from the box 12, whereupon the water level therein rises, causing the float to rise and thereby close the valve 51.

It will be noted that in all of the illustrated embodiments of the vent siphon line shown, the air withdrawn from the water boxes is advantageously released into the water discharge pipe 16 at a level below the level of entry of water into the system via the inlet 15, but above the level of the outlet 17 from the heat exchanger system.

The invention has been described and illustrated with respect to certain presently preferred embodiments, but those acquainted with the heat exchanger art will appreciate that numerous modifications, adaptations and applications of the invention can be made within the spirit and scope of the invention. For example, the vacuum pump arrangement of FIG. 4 could be substituted for the suction cup 31 of FIG. 3; or the suction cup 31 of FIG. 3 could be replaced by a venturi tube like the tube 21 shown in FIG. 2. What is described and shown is a passive vent arrangement for removing trapped air and non-condensible gases continuously and automatically from the water boxes of a heat exchanger.

What is claimed is:

1. In combination with a condenser having an inlet water box and an outlet water box, an arrangement for using the flow of coolant water being discharged from the condenser to create a partial vacuum in a conduit means leading form conduit openings in a top portion of the inlet and outlet water boxes of the condenser to a lower opening of the conduit means within the discharging flow path of said coolant water from said condenser, to withdraw air and non-condensible gases from the water boxes through said conduit means to discharge into said discharging coolant water flow.

2. The arrangement of claim 1 wherein said conduit means leads from an outlet water box of the condenser to a discharge pipe for water being discharged from the condenser.

3. The arrangement of claim 1 wherein the partial vacuum is created by means of a venturi tube positioned in a discharge pipe for water being discharged from said condenser.

4. The arrangement of claim 1 wherein said conduit means leads from an outlet water box of the condenser to a discharge pipe for water being discharged from said condenser, and means for introducing water under pressure into said conduit means is provided at a lower portion of said conduit means.

5. The arrangement of claim 4 wherein the means for introducing water under pressure into said conduit means includes a venturi tube.

6. The arrangement of claim 1 wherein said partial vacuum is created by a vacuum pump driven by means responsive to the flow of water being discharged from the condenser.

7. The arrangement of claim 6 wherein the means responsive to the flow of water is a propeller positioned in a discharge pipe for water being discharged from the heat exchanger.

8. In combination with a surface condenser having an inlet water box and an outlet water box, means for withdrawing air trapped within said water boxes and for the discharge of withdrawn air along with water being discharged from said surface condenser, said means for withdrawing trapped air comprising means for creating a partial vacuum in response to the flow of water being discharged from the surface condenser.

9. The apparatus of claim 8 and further comprising a conduit means leading from said water boxes to a discharge pipe for discharging water from said surface condenser.

10. The apparatus of claim 9 wherein said conduit means terminates in suction creating means within said discharge pipe.

11. The apparatus of claim 10 and including means for introducing water under pressure into said conduit means at a lower portion of said conduit means.

12. The apparatus of claim 11 wherein said means for introducing water under pressure into said conduit means includes a venturi tube.

13. The apparatus of claim 9 and including means for introducing water under pressure into said conduit means at a lower portion of said conduit.

14. The apparatus of claim 13 wherein said means for introducing water under pressure into said conduit includes a venturi tube.

15. The apparatus of claim 14 wherein said means for introducing water under pressure into aid conduit means comprises a priming conduit conducted to said venturi tube, an exterior source of priming water for said venturi with said priming conduit connected thereto, a valve in said priming conduit, and float means for sensing the water level in said outlet box and connected to said valve whereby said valve is opened when said sensing means senses a predetermined drop in said water level and said valve is closed when said sensing means senses a predetermined higher water level.

16. The apparatus of claim 9 wherein said conduit means terminates within a venturi tube within said discharge pipe.

17. The apparatus of claim 8 wherein said means for creating a partial vacuum comprises a pump driven by the flow of water being discharged from the surface condenser.

18. A method for improving the performance of a condenser of the type having an inlet water box and an outlet coolant water box which comprises using the flow of coolant water being discharged from the condenser for creating a partial vacuum to withdraw air and non-condensible gases from said water boxes to discharge withdrawn air along with said water being discharged.

19. The method of claim 18 wherein said air and non-condensible gases are withdrawn from said water boxes via a conduit means leading from upper portions of said water boxes to a discharge pipe for water being discharged from said condenser.

20. The method of claim 18 and including creating said partial vacuum by means of the venturi effect.

21. The method of claim 18 wherein said air and non-condensible gases are withdrawn continuously during operation of the condenser.

* * * * *

UNITED STATES PATENT AND TRADEMARK OFFICE

CERTIFICATE OF CORRECTION

PATENT NO. : 4,892,140

DATED : January 9, 1990

INVENTOR(S) : Tito D. Honovich

It is certified that error appears in the above-identified patent and that said Letters Patent is hereby corrected as shown below:

Column 3, line 1 "aND" should read --and--; line 47, after "that" delete "a", insert --the--; line 53, delete "such", insert --suck--

Column 5, line 56, delete "form", insert --from--

Column 6, line 48, delete "aid", insert --said--

Signed and Sealed this

Nineteenth Day of February, 1991

*Attest:*

HARRY F. MANBECK, JR.

*Attesting Officer*

*Commissioner of Patents and Trademarks*